US011331824B2

(12) United States Patent
Myllykangas et al.

(10) Patent No.: US 11,331,824 B2
(45) Date of Patent: May 17, 2022

(54) METHOD AND DEVICE FOR INSERTING A TONGUE

(71) Applicant: Välinge Innovation AB, Viken (SE)

(72) Inventors: Fredrik Myllykangas, Uddevalla (SE); Jonas Fransson, Allerum (SE)

(73) Assignee: VALINGE INNOVATION AB, Viken (SE)

( * ) Notice: Subject to any disclaimer, the term of this patent is extended or adjusted under 35 U.S.C. 154(b) by 574 days.

(21) Appl. No.: 15/635,379

(22) Filed: Jun. 28, 2017

(65) Prior Publication Data

US 2018/0001509 A1 Jan. 4, 2018

(30) Foreign Application Priority Data

Jun. 29, 2016 (SE) ..... 1650940-8

(51) Int. Cl.

| | |
|---|---|
| ***B27F 1/12*** | (2006.01) |
| ***E04F 15/02*** | (2006.01) |
| ***B27G 13/00*** | (2006.01) |
| ***B27G 13/08*** | (2006.01) |

(52) U.S. Cl.

CPC ..... *B27F 1/12* (2013.01); *B27G 13/005* (2013.01); *B27G 13/08* (2013.01); *E04F 15/02038* (2013.01); *E04F 2201/0146* (2013.01); *E04F 2201/0547* (2013.01)

(58) Field of Classification Search

CPC ..... B27F 1/12; B27G 13/005; B27G 13/08; E04F 15/02038; E04F 2201/0146; E04F 2201/0547; B26D 7/2642; B25B 23/045

See application file for complete search history.

(56) References Cited

U.S. PATENT DOCUMENTS

| | | | | |
|---|---|---|---|---|
| 1,194,636 A | | 8/1916 | Joy | |
| 1,667,522 A | * | 4/1928 | Amezaga | A61F 13/64 604/398 |
| 1,687,522 A | | 10/1928 | Staude | |
| 1,902,716 A | | 3/1933 | Newton | |
| 2,113,843 A | * | 4/1938 | Kavle | B21D 28/36 83/117 |

(Continued)

FOREIGN PATENT DOCUMENTS

| | | |
|---|---|---|
| BE | 1 019 989 A3 | 3/2013 |
| BE | 1 020 211 A5 | 6/2013 |

(Continued)

OTHER PUBLICATIONS

Extended European Search Report dated Jan. 2, 2020 in EP 17820655.3, European Patent Office, Munich, DE, 14 pages.

(Continued)

*Primary Examiner* — Evan H Macfarlane
*Assistant Examiner* — Liang Dong
(74) *Attorney, Agent, or Firm* — Buchanan Ingersoll & Rooney P.C.

(57) ABSTRACT

A method and device for managing and separating a tongue from a tongue blank, including cutting a first edge of a tongue from the tongue blank by rotating a tool which includes a protruding part, and displacing the tongue by the protruding part to a tongue queue. The method and device may include a second tool for cutting a second edge of the tongue from the tongue blank.

19 Claims, 5 Drawing Sheets

(56) References Cited

U.S. PATENT DOCUMENTS 3,003,403 A * 10/1961 Goettsch ..... B26D 7/2635 493/365
3,114,477 A 12/1963 Dixon
3,143,335 A 8/1964 Lassahn
3,147,522 A 9/1964 Schumm
3,381,730 A 5/1968 Omholt
3,572,224 A 3/1971 Perry
3,579,941 A 5/1971 Tibbals
3,584,761 A 6/1971 Flanigan et al.
3,720,027 A 3/1973 Christensen
3,760,485 A 9/1973 Smith
3,760,547 A 9/1973 Brenneman
3,778,954 A 12/1973 Meserole
3,919,820 A 11/1975 Green
3,930,808 A 1/1976 Miller et al.
3,961,408 A 6/1976 Goodsmith
4,098,173 A * 7/1978 Schauman ..... B26D 7/2642 493/18
4,167,884 A * 9/1979 Santanna ..... B26D 1/0006 493/365
4,332,203 A 6/1982 Flowers
4,648,165 A 3/1987 Whitehorne
4,899,438 A 2/1990 Muller et al.
5,105,980 A 4/1992 Hofmann
5,174,022 A 12/1992 Phillips et al.
5,388,721 A * 2/1995 Mauer ..... B21J 15/32 221/74
5,582,611 A 12/1996 Tsuruta et al.
5,636,426 A 6/1997 Luckhardt et al.
5,810,239 A 9/1998 Stich
5,890,409 A * 4/1999 Carlton ..... B26D 1/0006 83/678
5,996,876 A 12/1999 Dickhoff et al.
6,098,442 A 8/2000 Walldorf et al.
6,273,315 B1 8/2001 McGuinness et al.
6,314,701 B1 11/2001 Meyerson
6,363,677 B1 4/2002 Chen et al.
6,385,936 B1 5/2002 Schneider
6,413,007 B1 7/2002 Lambright
6,418,683 B1 7/2002 Martensson et al.
6,446,413 B1 9/2002 Gruber
6,490,836 B1 12/2002 Moriau et al.
6,505,452 B1 1/2003 Hannig
6,592,015 B1 7/2003 Gostylla et al.
6,631,827 B2 10/2003 Goodsmith
6,647,690 B1 11/2003 Martensson
6,651,400 B1 11/2003 Murphy
6,655,573 B1 12/2003 Chang
6,763,643 B1 7/2004 Martensson
6,766,622 B1 7/2004 Thiers
6,769,835 B2 8/2004 Stridsman
6,804,926 B1 10/2004 Eisermann
6,807,719 B2 10/2004 Herr et al.
6,843,402 B2 1/2005 Sims et al.
6,854,235 B2 2/2005 Martensson
6,880,307 B2 4/2005 Schwitte et al.
7,040,068 B2 5/2006 Moriau et al.
7,051,486 B2 5/2006 Pervan
7,188,456 B2 3/2007 Knauseder
7,255,256 B2 8/2007 McGee et al.
7,344,057 B2 3/2008 Dion et al.
7,451,578 B2 11/2008 Hannig
7,454,875 B2 11/2008 Pervan et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,631,586 B2 * 12/2009 Agata ..... B26D 7/2642 493/365
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,896,571 B1 3/2011 Hannig et al.
7,908,815 B2 3/2011 Pervan et al.
7,908,816 B2 3/2011 Grafenauer
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,061,248 B2 * 11/2011 Svensson ..... B26D 3/14 83/332
8,079,196 B2 12/2011 Pervan
8,091,238 B2 1/2012 Hannig
8,112,967 B2 2/2012 Pervan et al.
8,171,692 B2 5/2012 Pervan
8,181,416 B2 5/2012 Pervan et al.
8,234,830 B2 8/2012 Pervan et al.
8,256,104 B2 9/2012 Fulbright
8,302,367 B2 11/2012 Schulte
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,738 B2 2/2014 Schulte
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,340 B2 7/2014 Pervan et al.
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,120,141 B2 9/2015 Clew et al.
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.

(56) References Cited

U.S. PATENT DOCUMENTS 9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,826 B2 1/2017 Pervan et al.
9,555,529 B2 1/2017 Ronconi
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,307,815 B2 6/2019 Badent et al.
10,352,049 B2 7/2019 Boo
10,358,830 B2 7/2019 Pervan
10,378,217 B2 8/2019 Pervan
10,458,125 B2 10/2019 Pervan
10,519,676 B2 12/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,800,061 B2 * 10/2020 Yamamuro ..... B26D 1/405
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
11,078,673 B2 8/2021 Pervan et al.
11,091,920 B2 8/2021 Kell
11,131,099 B2 9/2021 Pervan
11,174,646 B2 11/2021 Pervan
11,193,283 B2 12/2021 Pervan et al.
2002/0031646 A1 3/2002 Chen et al.
2002/0170259 A1 11/2002 Ferris
2002/0178674 A1 12/2002 Pervan
2003/0009971 A1 1/2003 Palmberg
2003/0024199 A1 2/2003 Pervan et al.
2003/0037504 A1 2/2003 Schwitte et al.
2003/0180091 A1 9/2003 Stridsman
2003/0188504 A1 10/2003 Eisermann
2003/0196405 A1 10/2003 Pervan
2004/0016196 A1 1/2004 Pervan
2004/0031227 A1 2/2004 Knauseder
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0200175 A1 10/2004 Weber
2004/0211143 A1 10/2004 Hannig
2004/0244325 A1 12/2004 Nelson
2004/0261348 A1 12/2004 Vulin
2005/0081373 A1 4/2005 Seidler
2005/0160694 A1 7/2005 Pervan
2005/0021081 A1 9/2005 Pervan
2005/0205161 A1 9/2005 Lewark
2006/0070333 A1 4/2006 Pervan
2006/0101769 A1 5/2006 Pervan
2006/0162814 A1 7/2006 Symossek et al.
2006/0236642 A1 10/2006 Pervan
2006/0260254 A1 11/2006 Pervan et al.
2007/0006543 A1 1/2007 Engström
2007/0011981 A1 1/2007 Eiserman
2007/0028547 A1 2/2007 Grafenauer
2007/0151189 A1 7/2007 Yang et al.
2007/0175156 A1 8/2007 Pervan et al.
2007/0193178 A1 8/2007 Groeke et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0043333 A1 2/2010 Hannig et al.
2010/0218360 A1 9/2010 Mangone, Jr.
2010/0293879 A1 11/2010 Pervan et al.
2010/0300031 A1 12/2010 Pervan et al.
2010/0313714 A1 12/2010 Smith
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0088346 A1 4/2011 Hannig
2011/0094083 A1 4/2011 Schulte
2011/0154763 A1 6/2011 Bergelin et al.
2011/0167750 A1 7/2011 Pervan
2011/0167751 A1 7/2011 Engström
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0073235 A1 3/2012 Hannig
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan

(56) References Cited

U.S. PATENT DOCUMENTS

| | | | |
|---|---|---|---|
| 2013/0160391 | A1 | 6/2013 | Pervan et al. |
| 2013/0232905 | A2 | 9/2013 | Pervan |
| 2013/0239508 | A1 | 9/2013 | Pervan et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0033634 | A1 | 2/2014 | Pervan |
| 2014/0042203 | A1 | 2/2014 | Abe |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0138422 | A1 | 5/2014 | Ronconi |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0305065 | A1 | 10/2014 | Pervan |
| 2014/0338177 | A1 | 11/2014 | Vermeulen et al. |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0059281 | A1 | 3/2015 | Pervan |
| 2015/0078819 | A1 | 3/2015 | Derelöv et al. |
| 2015/0089896 | A2 | 4/2015 | Pervan et al. |
| 2015/0121796 | A1 | 5/2015 | Pervan |
| 2015/0152644 | A1 | 6/2015 | Boo |
| 2015/0167318 | A1 | 6/2015 | Pervan |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0321325 | A1 | 11/2015 | Vandenberg |
| 2015/0330088 | A1 | 11/2015 | Derelov |
| 2015/0336224 | A1 | 11/2015 | Liu et al. |
| 2015/0337537 | A1 | 11/2015 | Boo |
| 2016/0032596 | A1 | 2/2016 | Nygren et al. |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0129573 | A1 | 5/2016 | Anstett et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0000151 | A1 | 1/2018 | Fransson |
| 2018/0001573 | A1 | 1/2018 | Blomgren et al. |
| 2018/0002933 | A1 | 1/2018 | Pervan |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2019/0024387 | A1 | 1/2019 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |
| 2020/0087927 | A1 | 3/2020 | Pervan |
| 2020/0102756 | A1 | 4/2020 | Pervan |
| 2020/0109569 | A1 | 4/2020 | Pervan |
| 2020/0149289 | A1 | 5/2020 | Pervan |
| 2020/0173175 | A1 | 6/2020 | Pervan |
| 2020/0224430 | A1 | 7/2020 | Ylikangas et al. |
| 2020/0263437 | A1 | 8/2020 | Pervan |
| 2020/0284045 | A1 | 9/2020 | Kell |
| 2020/0318667 | A1 | 10/2020 | Derelöv |
| 2020/0354969 | A1 | 11/2020 | Pervan et al. |
| 2020/0412852 | A9 | 12/2020 | Pervan et al. |
| 2021/0016465 | A1 | 1/2021 | Fransson |
| 2021/0047840 | A1 | 2/2021 | Pervan et al. |
| 2021/0047841 | A1 | 2/2021 | Pervan et al. |
| 2021/0071428 | A1 | 3/2021 | Pervan |
| 2021/0087831 | A1 | 3/2021 | Nilsson et al. |
| 2021/0087832 | A1 | 3/2021 | Boo |
| 2021/0087833 | A1 | 3/2021 | Ylikangas et al. |
| 2021/0087834 | A1 | 3/2021 | Ylikangas et al. |
| 2021/0310257 | A1 | 10/2021 | Boo |
| 2021/0348396 | A1 | 11/2021 | Pervan et al. |
| 2021/0381255 | A1 | 12/2021 | Ylikangas et al. |

FOREIGN PATENT DOCUMENTS

| | | | |
|---|---|---|---|
| BR | PI 0906645-4 | A2 | 9/2009 |
| DE | 25 05 489 | A1 | 8/1976 |
| DE | 197 52 286 | A1 | 5/1999 |
| DE | 202 05 774 | U1 | 8/2002 |
| DE | 203 20 799 | U1 | 4/2005 |
| DE | 10 2004 055 951 | A1 | 7/2005 |
| DE | 10 2004 062 648 | | 7/2006 |
| DE | 10 2006 057 491 | A1 | 6/2008 |
| EP | 0 974 713 | A1 | 1/2000 |
| EP | 1 420 125 | A2 | 5/2004 |
| EP | 1 650 375 | A1 | 4/2006 |
| EP | 1 674 223 | A1 | 6/2006 |
| EP | 1 650 375 | A8 | 9/2006 |
| EP | 1 674 223 | B1 | 7/2008 |
| EP | 2 395 179 | A2 | 12/2011 |
| EP | 2 276 614 | B1 | 9/2012 |
| EP | 2 689 904 | A1 | 1/2014 |
| EP | EP 2 689 904 | | 1/2014 |
| EP | 2 732 923 | A2 | 5/2014 |
| EP | 2 774 735 | A1 | 9/2014 |
| EP | 2 732 923 | B1 | 1/2018 |
| EP | 3 354 909 | A1 | 8/2018 |
| EP | 3 478 901 | A | 5/2019 |
| EP | 2 774 735 | B1 | 10/2019 |
| GB | 240629 | | 10/1925 |
| GB | 376352 | | 7/1932 |
| GB | 1171337 | | 11/1969 |
| SE | 529 076 | C2 | 4/2007 |
| WO | WO 94/26999 | A1 | 11/1994 |
| WO | WO 96/27721 | A1 | 9/1996 |
| WO | WO 97/47834 | A1 | 12/1997 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/51732 | A1 | 7/2001 |
| WO | WO 01/75247 | A1 | 10/2001 |

(56) References Cited

FOREIGN PATENT DOCUMENTS

| | | | |
|---|---|---|---|
| WO | WO 01/98604 | A1 | 12/2001 |
| WO | WO 03/016654 | A1 | 2/2003 |
| WO | WO 03/044303 | A1 | 5/2003 |
| WO | WO 03/083234 | A1 | 10/2003 |
| WO | WO 03/087497 | A1 | 10/2003 |
| WO | WO 2004/016877 | A1 | 2/2004 |
| WO | WO 2004/020764 | A1 | 3/2004 |
| WO | WO 2004/085765 | A1 | 10/2004 |
| WO | WO 2005/054599 | A1 | 6/2005 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/079845 | A1 | 7/2007 |
| WO | WO 2007/109787 | A2 | 9/2007 |
| WO | WO 2008/017301 | A2 | 2/2008 |
| WO | WO 2008/017301 | A3 | 2/2008 |
| WO | WO 2008/068245 | A1 | 6/2008 |
| WO | WO 2009/116926 | A1 | 9/2009 |
| WO | WO 2009/124517 | A1 | 10/2009 |
| WO | WO 2010/001262 | A2 | 1/2010 |
| WO | WO 2010/087752 | A1 | 8/2010 |
| WO | WO 2012/154113 | A1 | 11/2012 |
| WO | WO 2013/025164 | A1 | 2/2013 |
| WO | WO 2013/025165 | A1 | 2/2013 |
| WO | WO 2013/037904 | A2 | 3/2013 |
| WO | WO 2015/038059 | A1 | 3/2015 |
| WO | WO 2015/105451 | A1 | 7/2015 |
| WO | WO 2015/133768 | A1 | 9/2015 |
| WO | WO 2017/135874 | A1 | 8/2017 |

OTHER PUBLICATIONS

Extended European Search Report dated Dec. 9, 2019 in EP 17820656.1, European Patent Office, Munich, DE, 10 pages.

Extended European Search Report dated Jan. 30, 2020 in EP 17820652.0, European Patent Office, Munich, DE, 10 pages.

U.S. Appl. No. 16/839,657, filed Apr. 3, 2020, Derelöv.

Extended European Search Report dated Apr. 2, 2020 in EP 17820657.9, European Patent Office, Munich, DE, 4 pages.

Derelöv, Peter, U.S. Appl. No. 16/839,657, entitled "Automated Assembly," filed in the U.S. Patent and Trademark Office filed Apr. 3, 2020.

Fransson, Jonas, U.S. Appl. No. 17/060,325, entitled "Method and Device for Inserting a Tongue," filed in the U.S. Patent and Trademark Office, filed Oct. 1, 2020.

Extended European Search Report dated Jul. 22, 2020 in EP 17883594.8, European Patent Office, Munich, DE, 5 pages.

International Search Report and Written Opinion issued in PCT/EP2020/059600, dated Jul. 7, 2020, 14 pages, ISA/SE, European Patent Office, Rijswijk, NL.

Extended European Search Report dated Oct. 15, 2019 in EP 19167502.4, European Patent Office, Munich, DE, 6 pages.

U.S. Appl. No. 16/311,224, Jonas Fransson and Anders Aldsten, filed Dec. 19, 2018, (Cited herein as US Patent Application Publication No. 2019/0232473 A1 of Aug. 1, 2019.

International Search Report and Written Opinion issued in PCT/SE2017/050711, dated Sep. 19, 2017, 12 pages, SA/SE, Patent-och registreringsverket, Stockholm, SE.

U.S. Appl. No. 15/635,532, Jonas Fransson, filed Jun. 28, 2017, (Cited herein as US Patent Application Publication No. 2018/0001510 A1 of Jan. 4, 2018).

U.S. Appl. No. 15/635,619, Andreas Blomgren and Jonas Fransson, filed Jun. 28, 2017, (Cited herein as US Patent Application Publication No. 2018/0001573 A1 of Jan. 4, 2018).

U.S. Appl. No. 15/848,164, Jonas Fransson, Andreas Blomgren and Karl Erikson, filed Dec. 20, 2017, (Cited herein as US Patent Application Publication No. 2018/0178406 A1 of Jun. 28, 2018).

International Search Report and Written Opinion issued in PCT/SE2017/050718, dated Sep. 15, 2017, 11 pages, ISA/SE, Patent-och registreringsverket, Stockholm, SE.

International Search Report and Written Opinion issued in PCT/SE2017/050716, dated Sep. 15, 2017, 10 pages, ISA/SE, Patent-och registreringsverket, Stockholm, SE.

International Search Report and Written Opinion issued in PCT/SE2017/050717, dated Sep. 19, 2017, 13 pages, ISA/SE, Patent-och registreringsverket, Stockholm, SE.

International Search Report and Written Opinion issued in PCT/SE2017/051305, dated Mar. 5, 2018, 12 pages, ISA/SE, Patent-och registreringsverket, Stockholm, SE.

* cited by examiner

METHOD AND DEVICE FOR INSERTING A TONGUE

CROSS REFERENCE TO RELATED APPLICATIONS

The present application claims the benefit of Swedish Application No. 1650940-8, filed on Jun. 29, 2016. The entire contents of Swedish Application No. 1650940-8 are hereby incorporated herein by reference in their entirety.

FIELD OF THE INVENTION

Embodiments of the present invention relate to methods and devices for inserting a tongue into an insertion groove in a panel. The panel is configured to be arranged and locked perpendicular to an adjacent panel by a locking device comprising the tongue. The panels may be assembled and locked together to obtain a furniture product, such as a bookshelf, a cupboard, a wardrobe, a box, a drawer or a furniture component.

BACKGROUND OF THE INVENTION

A conventional furniture product may be assembled by a plurality of elements or panels. The panels may be assembled with a mechanical locking device, such as disclosed in, for example, WO 2012/154113 A1. The product comprises a first panel connected perpendicularly to a second panel by a mechanical locking device comprising, an edge tongue at the first panel, an edge groove at the second panel and a flexible tongue in an insertion groove.

WO 2015/038059 discloses a product assembled by a plurality of panels that are locked by mechanical locking devices comprising a flexible tongue in an insertion groove.

The locking devices of the panels are generally produced in a production line by a continuous production process, comprising a number of milling tools. The edge groove and the insertion groove may extend contiguously from a front edge to a back edge of the panel. The edge groove is preferably covered at the front edge by a decorative layer. The edge groove and the insertion groove may also end before the front edge and/or the back edge as disclosed in, e.g., SE 1650135-5.

Embodiments of the present invention address a need to provide an improved method and an improved device for separating a tongue from a tongue blank before inserting the tongue into an insertion groove in a panel.

SUMMARY OF THE INVENTION

Accordingly, embodiments of the present invention preferably seek to mitigate, alleviate or eliminate one or more deficiencies, disadvantages or issues in the art, such as the above-identified, singly or in any combination by providing a method for managing and separating a tongue from a tongue blank.

A further object of embodiments of the invention is to provide a device for managing and separating a tongue from a tongue blank.

At least some of these and other objects and advantages that will be apparent from the description have been achieved by a first aspect of the invention comprising a method for managing and separating a tongue from a tongue blank, comprising cutting a first edge of a tongue from a tongue blank by rotating a tool, which comprises a protruding part, and displacing the tongue by the protruding part to a tongue queue. Managing and separating the tongue by a rotating tool may have the advantage that one and the same tool may be used for separating and displacing the tongue, and the time for separating and displacing the tongue may be decreased.

The cutting may comprise cutting the first edge between said rotating tool and a dye.

The method may comprise rotating the tool by a shaft, wherein the shaft comprises a rotating disc, and guiding the tongue by the rotating disc during the cutting. The disc may have the same shape as the rotating tool.

The method may comprise cutting a second edge of the tongue from the tongue blank by a second of said rotating tool.

The method may comprise compressing said tongue by the protruding part. A compression force, obtained by said compressing, may be utilized for displacing the tongue in the tongue queue.

The method may comprise compressing one or more of said tongue, positioned in the tongue queue, by the protruding part.

The method may comprise displacing the tongue by the protruding part, during the cutting, from an upper inlet to a lower outlet.

A second aspect of the invention comprises a device for managing and separating a tongue from a tongue blank, wherein the device comprises a rotatable tool with a curve shaped outer edge with a protruding part, wherein the curve shaped edge is configured to cut a first edge of the tongue from the tongue blank, and wherein the protruding part is configured to displace the tongue from a cutting position.

The tongue queue preferably comprises two or more tongues which are preferably identical or essentially identical to said tongue.

The device may comprise a dye at the cutting position, wherein the first edge is cut between the dye and the curved edge.

A radius, of a cutting segment of the curve shaped outer edge, may be increasing along the cutting segment.

The device may comprise a second of said rotatable tool configured to cut a second edge of the tongue from the tongue blank.

The device may comprise a shaft and the rotatable tool may be attached to the shaft, wherein the device further comprises a rotatable disc, which may be attached to the shaft and configured to guide the tongue during the cutting.

The device may comprise a second of said rotatable tool, which is attached to the shaft, configured to cut a second edge of the tongue from the tongue blank, wherein the rotatable disc is attached to the shaft between the rotatable tool and said second rotatable tool.

The device may comprise an upper inlet at a first side of the cutting position and a lower outlet at a second side of the cutting position, wherein the protruding part is configured to displace the tongue from the upper inlet to the lower outlet.

The device may comprise a blocking device, which is positioned between the upper inlet and the lower outlet, configured to prevent the tongue from being displaced from the lower outlet towards the upper inlet.

The protruding part may be configured to compress the tongue in the outlet.

The tongue according to the first and/or second aspect may comprise one or more of the features below:

The tongue may be of an elongated shape and may comprise a first long edge and a second long edge. The first edge may be a first short edge, and the second edge may be an opposite second short edge.

A longitudinal direction of the tongue is preferably parallel to an axis of rotation of the rotatable/rotating tool.

The tongue may be a flexible tongue and made of, e.g., a polymer and preferably comprising a reinforcement material, such as a fibre, e.g., fiberglass.

The tongue may comprise a bendable part at the first long edge and preferably a groove adjacent the bendable part. The bendable part may be configured to be pushed into the groove adjacent the bendable part. The tongue may comprise several of said bendable part and preferably several of said groove.

The tongue may comprise a polymer material and is preferably produced by injection moulding.

The tongue may be connected to several tongues in the tongue blank by a first rail at the first short edge and preferably by a second rail at the second short edge.

The first rail and the second rail may extend in a length direction perpendicular to the tongue.

The tongue may be connected to the first rail and/or the second rail, which may be casting gates, by a first and a second casting gate, respectively The tongue is preferably configured to be displaceable in the insertion groove.

The device is preferably a part of a production line comprising milling tools for forming a locking device at the edge of the panel. The locking device preferably comprises said insertion groove.

The edge groove and the insertion groove may extend contiguously from a front edge to a back edge of the panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Figure 1A:
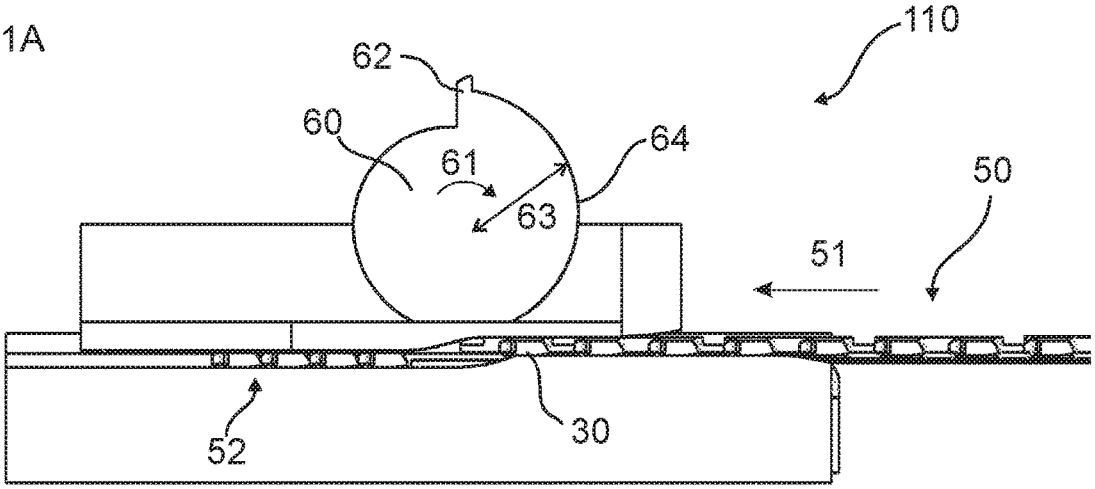
FIGS. 1A-1D show a method for managing and separating a tongue from a tongue blank according to an embodiment of the invention.
Figure 1B:
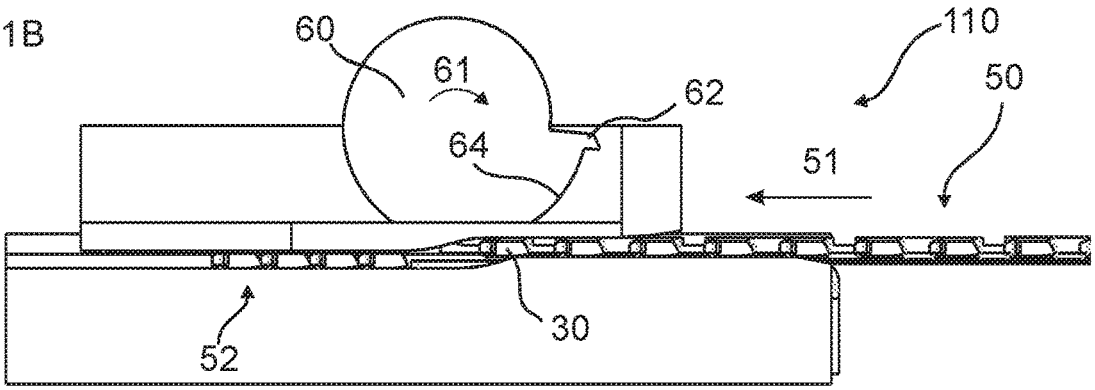
Figure 1C:
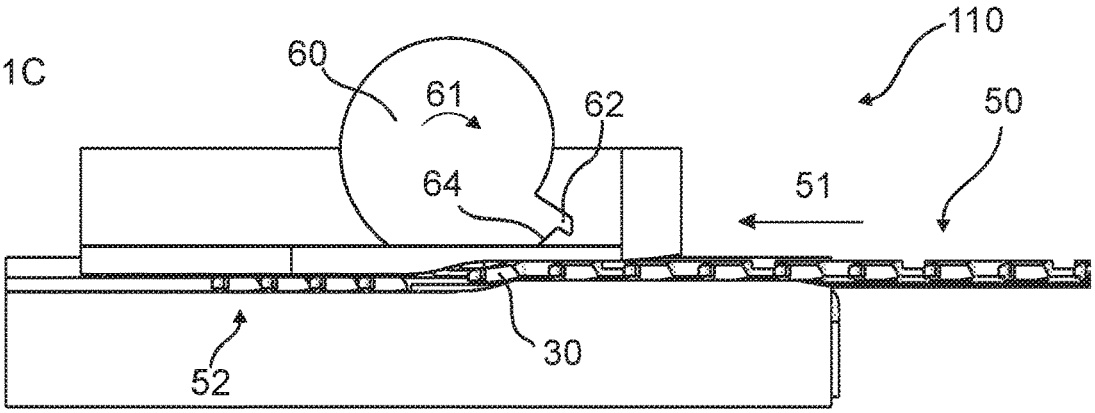

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Embodiments are shown that may improve managing and separating efficiency of a tongue from a tongue blank.

Figure 1D:
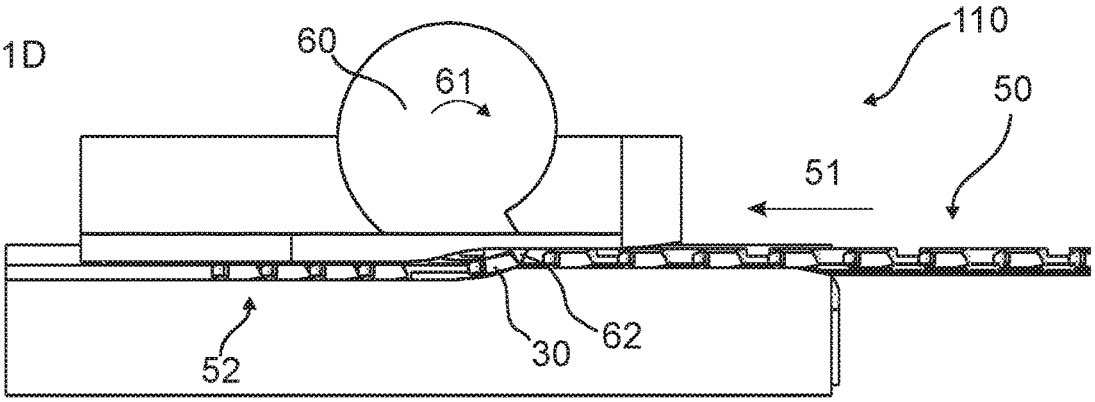

An embodiment of the method and a device 110 is shown in a side view in FIGS. 1A-1D from a starting position in FIG. 1A, with a protruding part 62 of a tool 60 facing upwards, to a position of contact between the protruding part 62 and a tongue 30 in FIG. 1D. The method comprises a method for managing and separating a tongue from a tongue blank, comprising cutting a first edge 34 of a tongue 30 from a tongue blank 50 by rotating 61 a tool 60 which comprises a protruding part 62, and displacing the tongue 30 by the protruding part 62 to a tongue queue 52. The tongue queue preferably comprises two or more tongues which are preferably identical or essentially identical to said tongue.

The tongue blank 50 is displaced in a feeding direction 51 towards the tool until a tongue of the tongue blank has reached a cutting position in the device 110.

A rail of the tongue blank 50 may have a length direction parallel to the feeding direction 51.

A longitudinal direction of the tongue 30, at the time of feeding and separation from the tongue blank, is preferably parallel to an axis of rotation of the rotatable/rotating tool 60.

The device may comprise a dye 76 and the tongue is cut between the tool and the dye. The tongue 30 is preferably displaced by means of the protruding part 62 when the tongue 30 is separated or almost separated from the tongue blank 50.

Figure 2A:
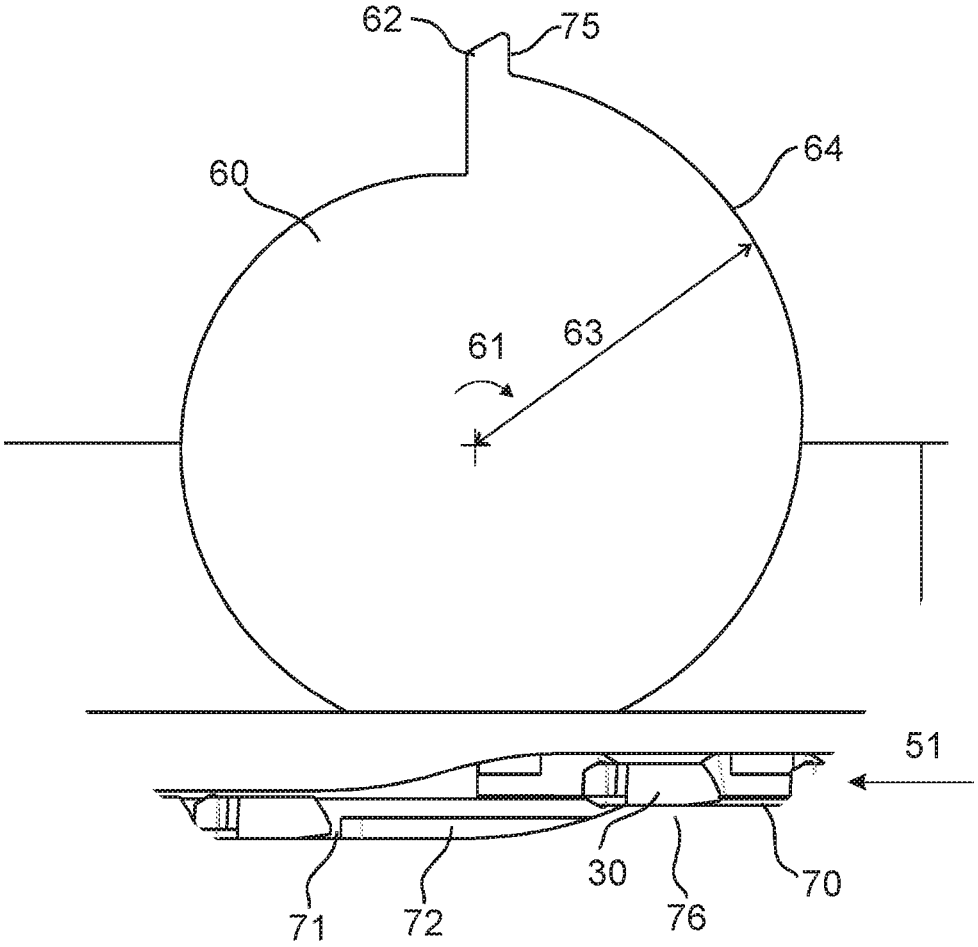
FIGS. 2A-2B show a device according to an embodiment of the invention.
Figure 2B:
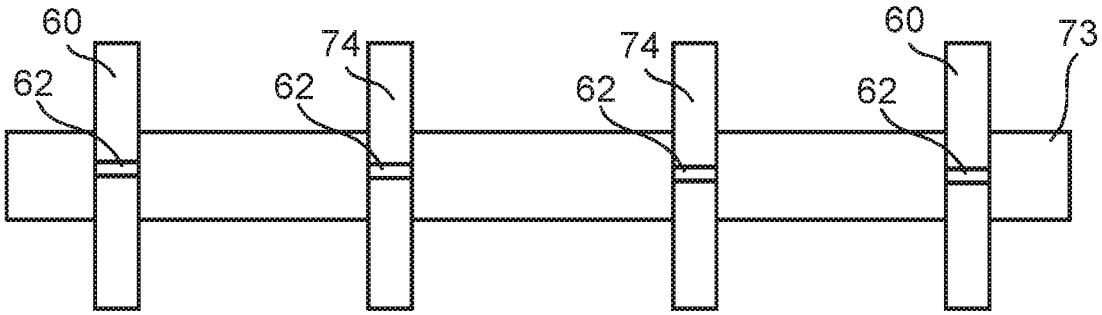

The method may comprise rotating the tool 60 by a shaft 73 see FIG. 2B, wherein the shaft comprises a rotating disc 74, and guiding the tongue 30 by the rotating disc during the cutting. The disc may have the same shape as the tool, and the device may comprise a free space under the disc, such that the tongue is guided and displaced without cutting the tongue apart.

Figure 4A:
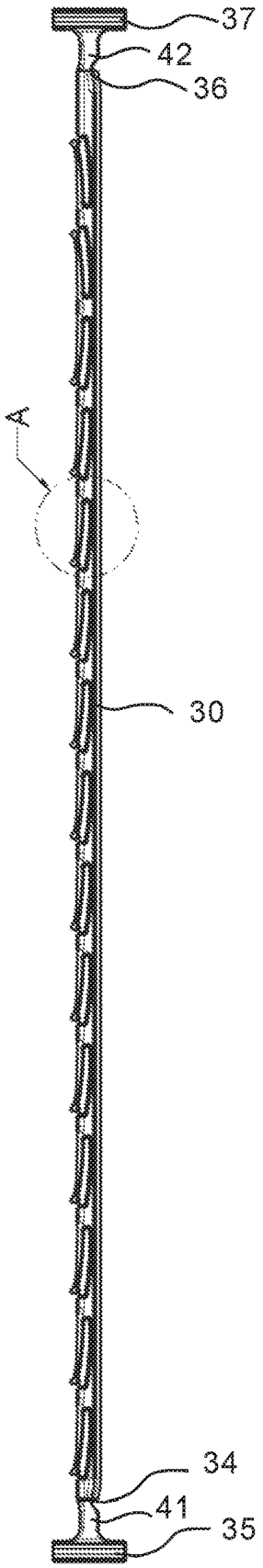
FIGS. 4A-4D show an embodiment of the tongue according to an embodiment of the invention.

The method preferably comprises cutting a second edge 36 of the tongue 30 from the tongue blank 50 by a second of said rotating tool 60, see FIG. 4A.

The method may comprise compressing said tongue 30 by the protruding part 62.

The method may comprise compressing the tongues in the tongue queue 52, by the protruding part 62.

The method may comprise displacing the tongue by the protruding part 62, during the cutting, from an upper inlet 70 to a lower outlet 71.

The method preferably comprises further rotating the tool 60 in the same direction 61 from the contact position in FIG. 1D (not shown) until the tool has reached the starting position in FIG. 1A.

FIG. 2A shows an enlargement of an area surrounding the tool 60 of the embodiment of the device 110, which is shown in FIG. 1A-1D. The device comprises a rotatable tool 60 with a curve shaped outer edge 64 with a protruding part 62, wherein the curve shaped edge 64 is configured to cut a first edge 34 of the tongue 30 from the tongue blank 50, and wherein the protruding part 62 is configured to displace the tongue 30 from a cutting position by means of a face 75.

A radius 63, of a cutting segment of the curve shaped outer edge 64, is increasing along the cutting segment. The cutting segment may be 45-180° of the arc of the tool, preferably 60-120° of the arc. The cutting segment may have a radius 63 that is longer than a radius of the remainder of tool (excepting the protruding part 62). The device may comprise a second of said rotatable tool 60 configured to cut a second edge 36 of the tongue from the tongue blank 50.

A periphery of the first tool, at least from the protruding part to another part of the periphery of the first tool in a counterclockwise manner, has an increasing radius along a spiraling curved shape edge portion which includes the cutting part.

The device may comprise a shaft 73, see FIG. 2B, and the rotatable tool 60 may be attached to the shaft 73, wherein the device may further comprise a rotatable disc 74, which is attached to the shaft 73 and configured to guide the tongue 30 during the cut.

Embodiments of the tongue 30 may have a longitudinal length in the range of about 30 mm to about 300 mm. Embodiments of the device for tongues with a longitudinal length in a lower part of the range may not comprise the rotatable disc 74.

The device may comprise a second of said rotatable tool 60, which may be attached to the shaft 73, configured to cut a second edge 36 of the tongue 30 from the tongue blank 50, wherein the rotatable disc 74 is preferably attached to the shaft 73 between the rotatable tool 60 and said second rotatable tool 60. The embodiment shown in FIG. 2B comprises said rotatable tool 60 attached to a first end of the shaft and a second of said rotatable tool 60 attached to a second end of the shaft and two of said rotatable disc 74, attached to the shaft between the rotatable tool and the second of said rotatable tool. The rotatable disc may have the same shape as the rotatable tool and comprise the protruding part 62.

The device may comprise an upper inlet 70 at a first side of the cutting position and a lower outlet 71 at a second side of the cutting position, wherein the protruding part 62 is configured to displace the tongue 30 from the upper inlet 70 to the lower outlet 71.

The device may comprise a blocking device 72, which is positioned between the upper inlet 70 and the lower outlet 71, configured to prevent the tongue from being displaced from the lower outlet 71 towards the upper inlet 70, by a compression force of compressed tongues in the tongue queue.

The protruding part 62 may be configured to compress the tongue 30 in the outlet 71.

The device may comprise a measuring device for determining the number of tongues in the tongue queue by measuring, e.g., the compression degree of the tongues. When the number of tongues in the tongue queue is to low the rotatable tool will feed another of said tongue into the tongue queue. The tongues in the tongue queue may be displaced by compression forces from the tongues in the tongue queue. A desired displacement of the tongues in the tongue queue may depend on the number of tongues in the tongue queue.

The measuring device may be an optical measuring device which may measure light transmission through the tongue queue. When the number of tongues in the tongue queue is low, the light transmission is high. An embodiment of the measuring device may measure the force from the compressed tongues in the tongue queue. A further embodiment of the measuring device may count the number of tongues that are fed into the tongue queue and the number of tongues that are fed out from the tongue queue.

Figure 3A:
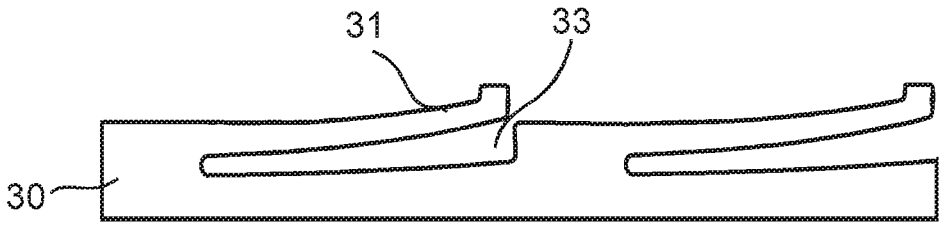
FIGS. 3A-3D show embodiments of the tongue according to embodiments of the invention.
Figure 3B:
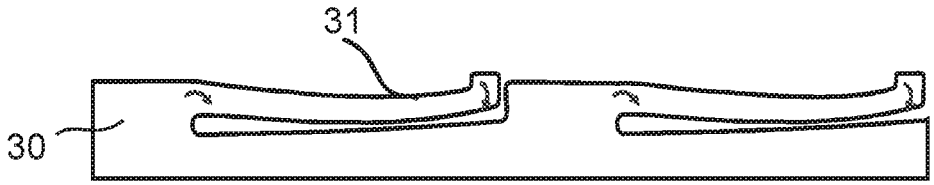
Figure 3C:
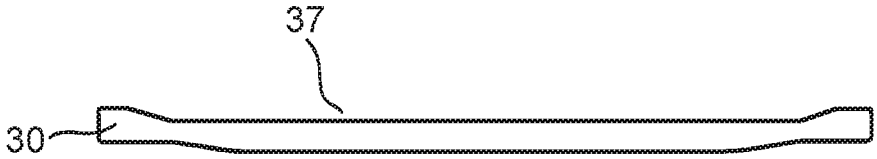
Figure 3D:
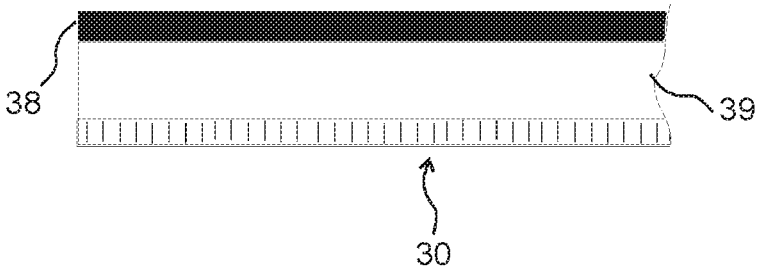

Embodiments of the tongue 30, which may be displaceable in an insertion groove 20, see FIGS. 5A-5D, are shown in FIGS. 3A-D. A first embodiment of the tongue, which is shown in FIG. 3A-3B, comprises bendable protruding parts 31 at a first long edge of the tongue. The first embodiment is shown in a relaxed state in FIG. 3A and in a compressed state in FIG. 3B. A second long edge of the tongue is preferably essentially straight. The first embodiment may be inserted into the insertion groove with the bendable protruding parts facing towards a bottom of the insertion groove and the second edge extending beyond an opening of the insertion groove. A second embodiment of the tongue, which is shown in FIG. 3C in a relaxed state, is of an elongated shape and flexible. The second embodiment comprises a recess 37 at a first long edge of the tongue and a second edge which is essentially straight. The recess is decreased in a compressed state of the second embodiment. The second embodiment may be inserted into the insertion groove with the recess 37 facing towards a bottom of the insertion groove and the second edge extending beyond an opening of the insertion groove. A third embodiment of the tongue, which is shown in FIG. 3D, comprises a first part 38, which is flexible and configured to be compressed, and a second part 39 which is rigid. The first part may be arranged in the insertion groove and the second part may partly extend beyond an opening of the insertion groove.

The tongue may be configured as any of the embodiments of the displaceable tongue disclosed in, e.g., WO 2006/043893 and WO 2007/015669, the entire contents of which are hereby expressly incorporated herein by reference.

The tongue may be flexible and made of, e.g., a polymer and preferably comprising a reinforcement material, such as a fibre, e.g., fiberglass.

Figure 4B:
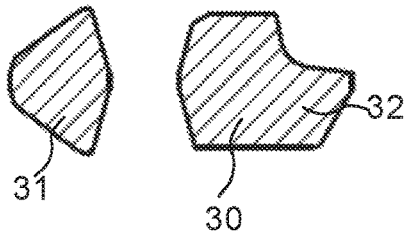
Figure 4C:
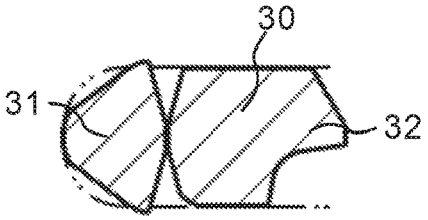
Figure 4D:
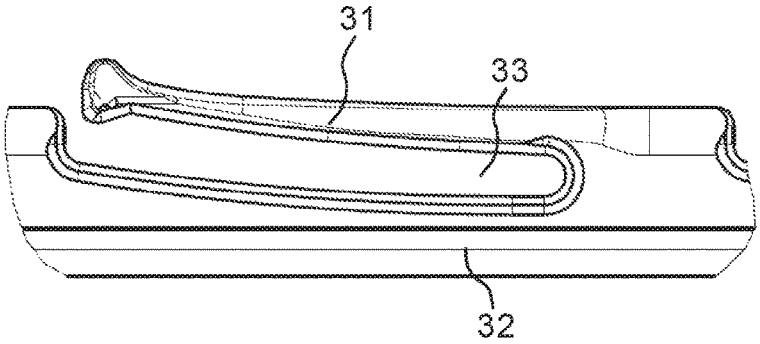

Another embodiment of the tongue 30 is shown in FIGS. 4A-D. The tongue is of an elongated shape and comprises a first short edge 34, an opposite second short edge 36, first long edge and a second long edge 32. FIG. 4D shows an enlargement of the encircled area A indicated in FIG. 4A. The tongue comprises several bendable parts 31 at the first long edge and a groove 33 at each bendable part 31. The tongue comprises a polymer material and is preferably produced by injection moulding. The bendable part 31 is configured to be pushed into the groove 33 in a compressed state of the tongue.

FIG. 4A shows an embodiment of tongue which is connected to several tongues (not shown) in a tongue blank by a first rail 35 at the first short edge 34 and by a second rail 37 at the second short edge 36. The first rail and the second rail extend in a length direction perpendicular to the tongue. In an embodiment, the rotatable tool 60 cuts the tongue 30 free from the first rail 35 and a second rotatable tool 60 cut the tongue 30 from the second rail 37. The tongue may be connected to the first rail and/or the second rail, which may be casting gates, by a first and a second casting gate 41, 42, respectively.

FIG. 4B and FIG. 4C show the tongue 30 in a cross cut view. The tongue is in FIG. 4B in a relaxed state an in FIG. 4C in a compressed state. A distance between an outer part of the bendable part 31 and the second long edge 32 is shorter in the compressed state compared to in the relaxed state.

The tongue is preferably configured to be inserted into an insertion groove of a panel for locking the panel to an adjacent panel.

FIGS. 5A-5D shows embodiments of the panel 1, each comprising an embodiment of the tongue 30 inserted in an embodiment of the insertion groove 20, connected to an adjacent panel 2. The embodiments of the panel shown in FIGS. 5A-5D may be furniture panels. The embodiment of the panel shown in FIG. 5C may also be a floor panel.

Figure 5A:
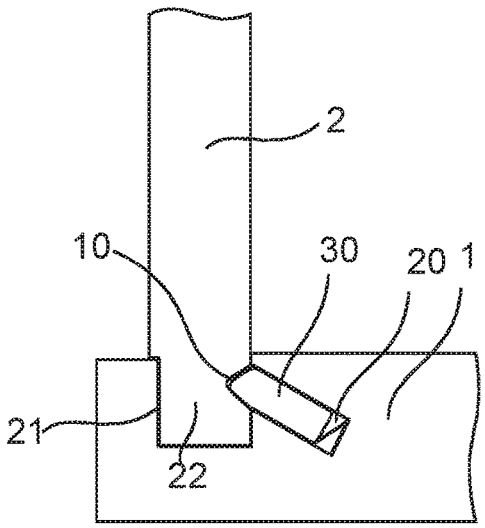
FIGS. 5A-5D show embodiments of the panel according to embodiments of the invention.

FIG. 5A shows the panel 1 arranged perpendicular to an adjacent panel 2 and locked to the adjacent panel in a first direction and in a second direction, which is perpendicular to the first direction. The panel comprising an edge groove 21 at an upper surface of the panel. The edge groove 21 is of a longitudinal shape and extends along an edge of the panel 1. The edge groove comprising said insertion groove 20, which is extending along the edge groove, comprising said tongue 30. The adjacent panel comprises an edge tongue 22 which comprises a tongue groove 10 extending along an edge of the adjacent panel. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 5B:
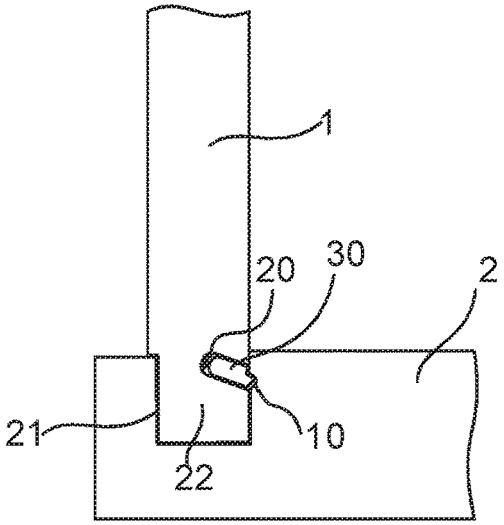

FIG. 5B shows the panel 1 arranged perpendicular to an adjacent panel 2 and locked to the adjacent panel in a first direction and in a second direction, which is perpendicular to the first direction. The adjacent panel comprising an edge groove 21 at an upper surface of the adjacent panel. The edge groove 21 is of a longitudinal shape and extends along an edge of the adjacent panel 1. The edge groove comprises a tongue groove 10. The panel comprises an edge tongue 22 which comprises said insertion groove 20 comprising said tongue 30. The insertion groove is extending along the edge tongue. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 5C:
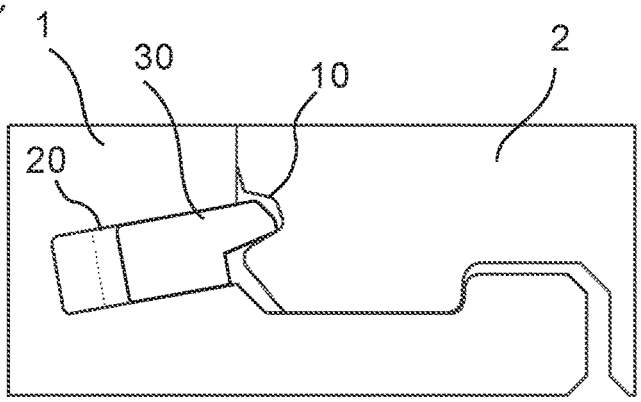

FIG. 5C shows the panel 1 arranged parallel to an adjacent panel 2 and locked to the adjacent panel in a first direction and in a second direction, which is perpendicular to the first direction. The panel comprising said insertion groove 20 which is extending along an edge of the panel. The edge comprises a strip protruding from the edge and the strip comprises an upwardly protruding locking element. The adjacent panel 2 comprises a tongue groove 10 extending along an adjacent edge of the adjacent panel 2. The adjacent edge comprises a locking groove with an opening facing downwards. The tongue 30 is configured to cooperate with the tongue groove 10 for locking the panel to the adjacent panel in a first direction and the locking element is configured to cooperate with the locking groove for locking the panel to the adjacent panel in the second direction. An embodiment of the said first and second panel comprises the insertion groove 20 at the adjacent edge of the adjacent panel and the tongue groove 10 at the edge of the panel.

Figure 5D:
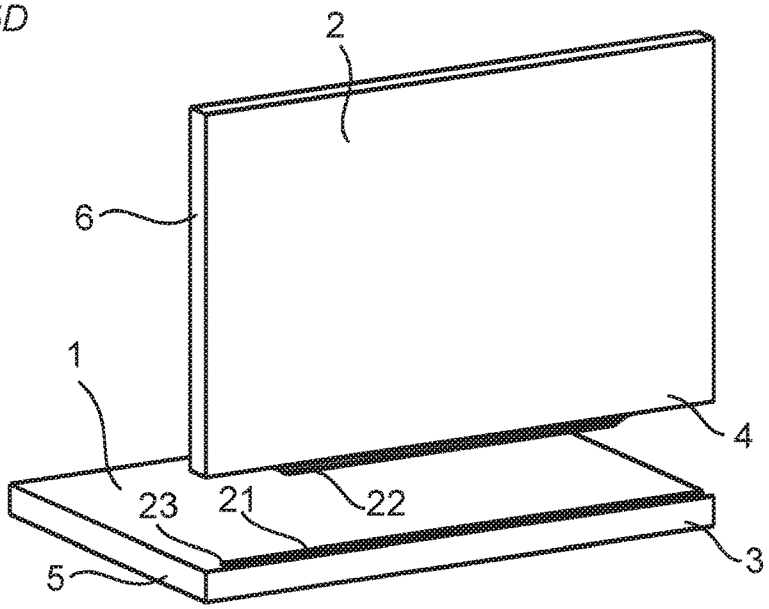

FIG. 5D shows an embodiment of the panel and the adjacent panel shown in FIG. 5A in a 3D-view. The edge tongue 22 is extending along the edge 4 of the adjacent panel and ends before an adjacent edge 6 of the adjacent panel 2. The edge groove 21 is extending along the edge 3 of the panel 1 and ends at a side wall 23 before an adjacent edge of the 5 of the panel 1.

A core material of embodiments of the panel and the adjacent panel described above may comprises a wood fibre based board, such as a HDF, MDF, plywood, solid wood or particleboard, or a reinforced plastic board or a wood fibre composite board. The core may be provided with a decorative layer.

EMBODIMENTS

1. A method for managing and separating a tongue from a tongue blank, comprising cutting a first edge (34) of a tongue (30) from a tongue blank (50) by rotating (61) a tool (60) which comprises a protruding part (62), displacing the tongue (30) by the protruding part (62) to a tongue queue (52).

2. The method as in embodiment 1, wherein the method comprises rotating the tool (60) by a shaft (73), wherein the shaft comprises a rotating disc (74), and guiding the tongue (30) by the rotating disc (74) during the cutting.

3. The method as in embodiment 1 or 2, wherein the method comprises cutting a second edge (36) of the tongue (30) from the tongue blank (50) by a second of said rotating tool (60).

4. The method as in any one of the embodiments 1-3, wherein the method comprises compressing said tongue (30) by the protruding part (62).

5. The method as in any one of the embodiments 1-4, wherein the method comprises compressing one or more of said tongue, positioned in the tongue queue (52), by the protruding part (62).

6. The method as in any one of the embodiments 1-5, wherein the method comprises displacing the tongue by the protruding part (62), during the cutting, from an upper inlet (70) to a lower outlet (71).

7. A device for managing and separating a tongue from a tongue blank, wherein the device comprises a rotatable tool (60) with a curve shaped outer edge (64) with a protruding part (62), wherein the curve shaped edge (64) is configured to cut a first edge (34) of the tongue (30) from the tongue blank (50), and wherein the protruding part (62) is configured to displace the tongue (62) from a cutting position.

8. The device as in embodiment 7, wherein a radius (63), of a cutting segment of the curve shaped outer edge (64), is increasing along the cutting segment.

9. The device as in any one of embodiments 7-8, wherein the device comprises a second of said rotatable tool (60) configured to cut a second edge (36) of the tongue from the tongue blank (50).

10. The device as in any one of embodiments 7-9, wherein the device comprises a shaft (73) and the rotatable tool (60) is attached to the shaft (73), wherein the device further comprises a rotatable disc (74), which is attached to the shaft (73) and configured to guide the tongue (30) during the cutting.

11. The device as in embodiment 10, wherein the device comprises a second of said rotatable tool (60), which is attached to the shaft (73), configured to cut a second edge (36) of the tongue (30) from the tongue blank (50), wherein the rotatable disc (74) is attached to the shaft (73) between the rotatable tool (60) and said second rotatable tool (60).

12. The device as in any one of embodiments 7-11, wherein the device comprises an upper inlet (70) at a first side of the cutting position and a lower outlet (71) at a second side of the cutting position, wherein the protruding part (62) is configured to displace the tongue (30) from the upper inlet (70) to the lower outlet (71).

13. The device as in embodiment 12, wherein the device comprises a blocking device (72), which is positioned between the upper inlet (70) and the lower outlet (71), configured to prevent the tongue from being displaced from the lower outlet (71) towards the upper inlet (70).

14. The device as in embodiment 12 or 13, wherein the protruding part (62) is configured to compress the tongue (30) in the lower outlet (71).

The invention claimed is:

1. A method for managing and separating a tongue from a tongue blank, wherein the tongue blank comprises a plurality of tongues, the method comprising:

cutting a first edge of one tongue of the plurality of tongues from the tongue blank by rotating a first tool which comprises a cutting part and a protruding part, displacing the one tongue by the protruding part to a tongue queue, wherein the cutting part and the protruding part are fixed with respect to each other during the cutting and displacing, wherein a periphery of the first tool, at least from the protruding part to another part of the periphery of the first tool, has an increasing radius along a spiraling curved shape edge portion which includes the cutting part.

2. The method as claimed in claim 1, wherein the method comprises rotating the first tool by a shaft, wherein the shaft supports a rotating disc, and guiding the one tongue by the rotating disc during the cutting.

3. The method as claimed in claim 1, wherein the method comprises cutting a second edge of the one tongue from the tongue blank by rotating a second tool.

4. The method as claimed in claim 1, wherein the method comprises compressing said one tongue by the protruding part.

5. The method as claimed in claim 1, wherein the method comprises compressing the one tongue, positioned in the tongue queue, by the protruding part.

6. The method as claimed in claim 1, wherein the method comprises displacing the one tongue by the protruding part, during the cutting, from an upper inlet to a lower outlet.

7. The method as claimed in claim 1, wherein the protruding part includes a face configured to push the tongue to displace the tongue from a cutting position, the face being parallel to an axis of rotation of the first tool.

8. The method as claimed in claim 7, wherein the face is a first face, and the protruding part includes a second face spaced from the first face and parallel to the axis of rotation of the first tool.

9. A device for managing and separating a tongue from a tongue blank, wherein the device comprises:

a first rotatable tool with a curve shaped cutting edge configured to cut the tongue from the tongue blank, and a protruding part that protrudes from the cutting edge of the first rotatable tool, wherein the protruding part is configured to displace the tongue from a cutting position after the tongue has been cut from the tongue blank, wherein a periphery of the first rotatable tool, at least from the protruding part to another part of the periphery of the first rotatable tool, has an increasing radius along a spiraling curved shape edge portion which includes the cutting edge.

10. The device as claimed in claim 9, wherein the device comprises a second rotatable tool configured to cut a second edge of the tongue from the tongue blank.

11. The device as claimed in claim 9, wherein the device comprises a shaft and the first rotatable tool is attached to the shaft, wherein the device further comprises a rotatable disc, which is attached to the shaft and configured to guide the tongue during the cutting.

12. The device as claimed in claim 11, wherein the device comprises a second rotatable tool, which is attached to the shaft, configured to cut a second edge of the tongue from the tongue blank, wherein the rotatable disc is attached to the shaft between the first rotatable tool and said second rotatable tool.

13. The device as claimed in claim 9, wherein the device comprises an upper inlet at a first side of the cutting position and a lower outlet at a second side of the cutting position, wherein the protruding part is configured to displace the tongue from the upper inlet to the lower outlet.

14. The device as claimed in claim 13, wherein the device comprises a blocking device, which is positioned between the upper inlet and the lower outlet, configured to prevent the tongue from being displaced from the lower outlet towards the upper inlet.

15. The device as claimed in claim 13, wherein the protruding part is configured to compress the tongue in the lower outlet.

16. The device as claimed in claim 9, wherein the protruding part includes a face configured to push the tongue to displace the tongue from the cutting position, the face being parallel to an axis of rotation of the first rotatable tool.

17. The device as claimed in claim 16, wherein the face is a first face, and the protruding part includes a second face spaced from the first face and parallel to the axis of rotation of the first rotatable tool.

18. The device as claimed in claim 9, wherein the device comprises a shaft and a second rotatable tool, which is attached to the shaft, the second rotatable tool configured to cut a second edge of the tongue from the tongue blank.

19. The device as claimed in claim 18, wherein the device comprises a rotatable disc attached to the shaft between the first rotatable tool and said second rotatable tool, and the rotatable disc includes a protruding part.

* * * * *